United States Patent [19]

Lazik

[11] 4,447,319

[45] May 8, 1984

[54] PROCESS FOR SEPARATING SAND FROM A BROWN COAL OR LIGNITE MATERIAL CONTAINING SAND

[75] Inventor: Paul Lazik, Cologne, Fed. Rep. of Germany

[73] Assignee: Rheinische Braunkohlenwerke AG, Cologne, Fed. Rep. of Germany

[21] Appl. No.: 393,727

[22] Filed: Jun. 30, 1982

[30] Foreign Application Priority Data

Jul. 6, 1981 [DE] Fed. Rep. of Germany ..... 3126585

[51] Int. Cl.[3] ..... B07B 9/02

[52] U.S. Cl. ..... 209/11; 209/37

[58] Field of Search ..... 209/11, 31, 36, 37

[56] References Cited

U.S. PATENT DOCUMENTS

| | | | |
|---|---|---|---|
| 201,234 | 3/1878 | Gathmann | 209/31 |
| 1,002,555 | 9/1911 | Benson | 209/318 |
| 1,019,470 | 3/1912 | Helgerson | 209/37 |
| 1,905,945 | 4/1933 | Machen | 209/36 |
| 2,808,929 | 10/1957 | Fisher | 209/36 |
| 2,908,391 | 10/1959 | Frevert | 209/315 |
| 2,956,347 | 10/1960 | Gordon | 209/36 |
| 3,016,203 | 1/1962 | Sears et al. | 209/315 |
| 3,261,463 | 7/1966 | Eveson et al. | 209/36 |
| 4,133,749 | 1/1979 | Jelinek et al. | 209/318 |
| 4,319,990 | 3/1982 | Muller | 209/365 |

FOREIGN PATENT DOCUMENTS

| | | | |
|---|---|---|---|
| 2023608 | 11/1971 | Fed. Rep. of Germany | 209/36 |
| 250291 | 3/1926 | United Kingdom | 209/36 |

OTHER PUBLICATIONS

Webster's Seventh New Collegiate Dictionary, p. 808, Cpr. 1965, Merriam Co.

*Primary Examiner*—Tim R. Miles

*Attorney, Agent, or Firm*—Howson and Howson

[57] ABSTRACT

In a process for separating sand from a brown coal or lignite material containing sand, wherein the sand is present entirely or predominantly in a grain size range covering only a part of the grain size range of the brown coal or lignite, with the grain size of the coarsest grains of the sand being markedly lower than the grain size of the coarsest coal grains, the coal in the grain size range between zero and at least the grain size corresponding to the maximum grain size of the sand is removed by a gaseous classifying operation, and the remaining material is subjected to a sieving or screening operation, the cut-off line of which is in the region of the grain size of the coarsest grains of the sand to be removed.

14 Claims, 2 Drawing Figures

PROCESS FOR SEPARATING SAND FROM A BROWN COAL OR LIGNITE MATERIAL CONTAINING SAND

BACKGROUND OF THE INVENTION

The present invention is concerned generally with the production of brown coal and lignite and more particularly with separating sand from a mined brown coal or lignite material which contains sand.

The terms brown coal and lignite are used interchangeably in this specification, although modern research may indicate that there may be certain differences between brown coal and lignite, from certain points of view; accordingly, where one such term is used, it is also to be deemed to include the other such term.

Although, by virtue of its chemical composition, sand is entirely inert in its behaviour upon combustion of or in other operations involving transforming brown coal or lignite, and therefore does not cause any environmental pollution, it is at least desirable and generally virtually essential for it to be at least substantially removed from the brown coal or lignite, when the amount of sand exceeds a given proportion, as otherwise a considerable amount of wear will occur in boilers or other equipment in which the sand-bearing coal or lignite is for example converted into gas or into liquid or reacted in some other manner.

The occurrence of a certain content of sand in mined brown coal or lignite, which constitutes a nuisance, is frequently inevitable even when the brown coal or lignite beds or seams are free from sand inclusions. However, with the present-day extraction methods and equipment, it is often inevitable that sand-bearing strata are also removed when mining coal from the roof and/or floor of a seam; that sand mixes with the coal and thus results in the raw brown coal or lignite material which comes out of the mine having a certain sand content. The sand content may be so high under some circumstances as to give rise to the difficulties referred to above. A similar situation may also arise for example when a stratum of sand of low thickness or strength occurs between two directly adjoining seams, as in such cases the stratum of sand cannot generally be shored up in the mining operation, and the mined material will inevitably include even higher proportions of sand.

These difficulties, which will be seen to arise due to the very nature of the beds or deposits and/or the mining process, have already been encountered for some decades, so that the problem of separating sand from a mining run of brown coal or lignite is not a new one. Accordingly, various attempts have been made in the past to overcome this difficulty and to remove sand from mined brown coal or lignite, or at least reduce the proportion of sand in such material to such an extent that the sand remaining in the brown coal or lignite does not give rise to difficulties such as those outlined above when the brown coal or lignite is subsequently put to use, and in particular therefore does not cause a significant amount of wear.

The reason that the problem of separating sand from a sand-bearing brown coal or lignite mix has not hitherto found a generally applicable solution is more particularly that the expenditure involved in separating out the sand cannot be at a very high level, as otherwise it becomes uneconomical to use the brown coal or lignite. This is essentially because the heating value of the brown coal or lignite is low, at any rate in comparison with other fossile fuels.

SUMMARY OF THE INVENTION

An object of the present invention is to provide a process for separating sand from a mined brown coal or lignite material containing sand.

Another object of the present invention is to provide a process for separating sand from brown coal or lignite, which can be carried into effect in an economical fashion.

A further object of the present invention is to provide such a process which does not require complicated and costly apparatus.

Yet another object of the present invention is to provide a process for separating sand from brown coal or lignite, which does not involve transferring the materials in question between a large number of different pieces of equipment.

A still further object of the present invention is to provide a process for separating sand from a mined mixture including sand and brown coal or lignite, which makes maximum use of the brown coal or lignite available in the material.

A yet further object of the present invention is to provide such a process which operates on the basis of a simple grain size separation action.

These and other objects are achieved by a process for separating sand from mined brown coal or lignite material containing sand, wherein the sand occurs predominantly or entirely in a particle or grain size range which covers only a part of the particle or grain size range in which the brown coal or lignite falls, with the grain size of the coarsest grains of sand being markedly below the grain size of the coarsest grains of the brown coal or lignite. The brown coal or lignite which is in the grain size range of between zero and at least the grain size corresponding to the maximum grain size of the sand to be removed is first removed from the material by at least one gaseous classifying operation. The remaining, coarse, material is then subjected to a sieving operation, the dividing or cut-off line in the sieving operation being in the region of the grain size of the coarsest grains of the sand to be removed.

In general terms, the process according to the present invention is based on the consideration that the sand present in the brown coal or lignite material is generally restricted to a given particle or grain size range so that, once the brown coal or lignite which is in and below that grain size range is removed, it is then possible to separate the coal and the sand by a grading or classifying operation, by making a suitable selection in respect of the position of the dividing line, so that sand forms the material which passes through the sieve and coal forms the material which passes over the sieve. When certain preconditions are observed in that operation, it is possible for the sand to be almost completely separated from the coal, although it will be appreciated that some incorrect grain sizes will inevitably occur, i.e. some material will be incorrectly graded by reference to grain size to the extent that is generally encountered in regard to any grading and gaseous classifying operations. The above-mentioned preconditions are met when the range of grain size of the sand is so narrow that coal of the grain size which corresponds to the coarsest grain size of the sand can still be removed by the gaseous classifying operation, without at the same time sand having the smallest grain size also being entrained with the coarsest coal grain by the classifying air flow; in other words, more or less complete removal of the coal grain size range in question in the air classifier is possible when coal in the grain size range of from zero up to the coarsest sand grain size does not belong to the same equal-settlement or equal-falling classes as the sand which is present in the coal. The conditions referred to above can be controlled within certain limits, for example by means of the moisture content of the coal in the material fed to the gaseous classifier. Thus, coal with a higher residual moisture content, that is to say, the moisture content which is still present in the coal after the coal had been subjected to a drying operation, will have a higher specific weight than otherwise corresponding coal but with a lower moisture content. In other words, the two kinds of coal, differing by virtue of their moisture contents, fall into different equal-falling classes. However, even when the above-mentioned condition is not met, that is to say, when the equal-falling classes in respect to brown coal or lignite on the one hand and sand on the other hand do not overlap, the process in accordance with the present invention can still be usefully employed as in any case a substantial proportion of the sand can be removed; the amount of residual sand remaining in the coal will substantially depend on the extent of overlapping between the above-mentioned classes and also the selected position of the respective dividing or cut-off lines. Reference may be made to the more particular example set out hereinafter, to illustrate this aspect:

The sand-bearing brown coal or lignite material which has been dried to give a residual water content of 6% is of a grain size range of from 0 to 1 mm. The sand contained therein is entirely or predominantly only in the grain size range of from 0.1 to 0.5 mm. If it is to be possible to separate the two components of the material from each other by a grading operation, the preceding gaseous classifying operation must be carried out in such a way that the residual material forming the coarse component resulting from the gaseous classifying operation has only one of its two components in the grain size range of from 0.1 to 0.5 mm. According to the invention, this is achieved by the brown coal or lignite which is in the grain size range of from 0.1 to 0.5 mm being removed from the mixed material by the above-mentioned gaseous classifying operation. This also has the necessary result that brown coal or lignite in the grain size range of from 0 to 0.1 mm, which is therefore below the above-mentioned range of from 0.1 to 0.5 mm, will also be removed as the air flow which is used for the gaseous classifying operation and which is so adjusted as to be capable of entraining a brown coal or lignite grain size of 0.5 mm at maximum will of course also entrain brown coal or lignite grains which are of smaller size. The criterion in regard to virtually complete removal of the coal in the grain size range of from 0 to 0.5 mm, while at the same time leaving the coarse component containing virtually all the sand which occurs in the grain size range of from 0.1 to 0.5 mm, is that the coal grain which is to be removed by the gaseous classifying operation, being of a maximum grain size of 0.5 mm, falls into a different equal-falling class from the smallest grain size of sand which occurs in the material fed to the gaseous classifying and which, in the example selected herein, is of a grain size of 0.1 mm. If the situation were different, if for example coal grain of 0.5 mm and sand grain of 0.1 mm fell into the same equal-falling class, the fraction of coal of from 0 to 0.5 mm, which would be removed by the gaseous classifying operation, would also contain the sand of a grain size of 0.1 mm. In such a case, it will depend on the respective circumstances involved whether it might be considered desirable for the dividing or cut-off line in the sifting operation to be lowered from the above-mentioned figure of 0.5 mm for example to 0.45 mm, in order thereby to avoid entraining the grains of sand having a grain size of 0.1 mm; it will be appreciated that, if that adjustment is made, the coarsest grains of sand of from 0.45 to 0.5 mm will remain in the coarse component forming the residual material. The choice to be made in regard to such adjustment will depend inter alia on the grain size range in which the larger proportion of sand occurs, that is to say, at 0.1 mm or between 0.45 and 0.5 mm.

Another possibility could involve even further reducing the water content of the coal so that the flow speed of the air would have to be reduced in order to give a dividing or cut-off line at 0.5 mm, with the result that, at that reduced flow speed, the smallest grains of sand, being of a grain size of 0.1 mm, are no longer entrained by the sifter air flow. Whether that is expedient or necessary will also depend on the respective circumstances, for example including the increased expenditure in regard to the drying operation, as it will be appreciated that the drying expenditure increases in an over-proportional manner, with decreasing residual moisture content.

Depending on the particular factors involved, it may be desirable for the location of the dividing line in the gaseous classifying operation to be such that it is directly above the maximum sand grain size. However, it may also be possible for the location of the dividing line in the gaseous classifying operation to be such that it occurs at a distance above the maximum sand grain size, for example at a grain size of 0.7 mm in the above-discussed example, whereby the proportion of defectively classifed grain will probably be reduced. It will be appreciated in this case also that this will generally only be desirable when the increased flow speed of classifying air, which is required for that purpose, does not result in the lower sand grain fractions also being removed with the coal fraction which is entrained by the classifier air flow.

In any case however, coal and sand can be separated after the gaseous classifying operation, using simple means, namely grading, as the above-mentioned dividing or cut-off line occurs in a range which is advantageous in regard to the sieving or screening operation. That would not be the case for example if the attempt were made to separate the fraction of from 0 to 0.1 mm grain size, which in the above-described example is assumed to be free of sand, from the mixture of sand and coal, by a sieving or screening operation.

For the purposes of reducing the proportion of wrongly gas classified grain, it would of course also be possible for the coarse component from the gaseous classifying operation to be subjected to a further sifting operation during the sieving or screening step. That also applies in regard to the material which passes through the sieve or screen and which may therefore also be subjected to a gaseous classifying operation, especially as it should be borne in mind that abrasion will often give rise to the formation of further brown coal or lignite which falls into the grain size range of from 0 to 0.5 mm, during the grading operation.

Conventional gaseous classifiers and sieving or screening equipment may be used for carrying out the gaseous classifying operation and the sieving operation. It has been found particularly advantageous to use the equipment referred to as stage sieves, wherein a plurality of sieves are arranged one above the other, and the angle of inclination of the individual sieves relative to the horizontal increases in a downward direction. Such sieve arrangements are commercially available under the name 'Mogensen sizers'. These arrangements comprise throw sieves, the surfaces of which are progressively inclined in a downward direction and the sizes of the holes of which are reduced in a downward direction.

It may also be possible for the process to be carried into effect in such a manner that the material comprising the sand and the coal is fed to the screening or sieving means in its entirety, that is to say, without a preliminary gaseous classifying operation, with the air sifting operation being performed during or in conjunction with the sieving operation so that it might be said that the gaseous classifying operation is superimposed on the sieving operation. In this connection, it should be noted that, when using the conventional throw sieves referred to above, the material being sieved is also loosened up to a considerable degree during the sieving operation, and that loosening effect facilitiates the gaseous classifying operation. Accordingly, that would involve the sieving means being arranged within a housing which at the same time performs the function of a gaseous classifying housing, that is to say, it also serves to guide the air flow for producing the gaseous classifying effect. With this mode of operation also, the material which passes through at least the upper sieve element is sifted, although this did not just involve removing coal grain, which was produced by abrasion, below the dividing or cut-off line, but on the contrary also involved removing the coal grain which was still present in the feed material from the outset and which was below the respective dividing or cut-off line. In the above-described example, that line occurs at a grain size of 0.5 mm.

DESCRIPTION OF PREFERRED EMBODIMENTS

Figure 1:
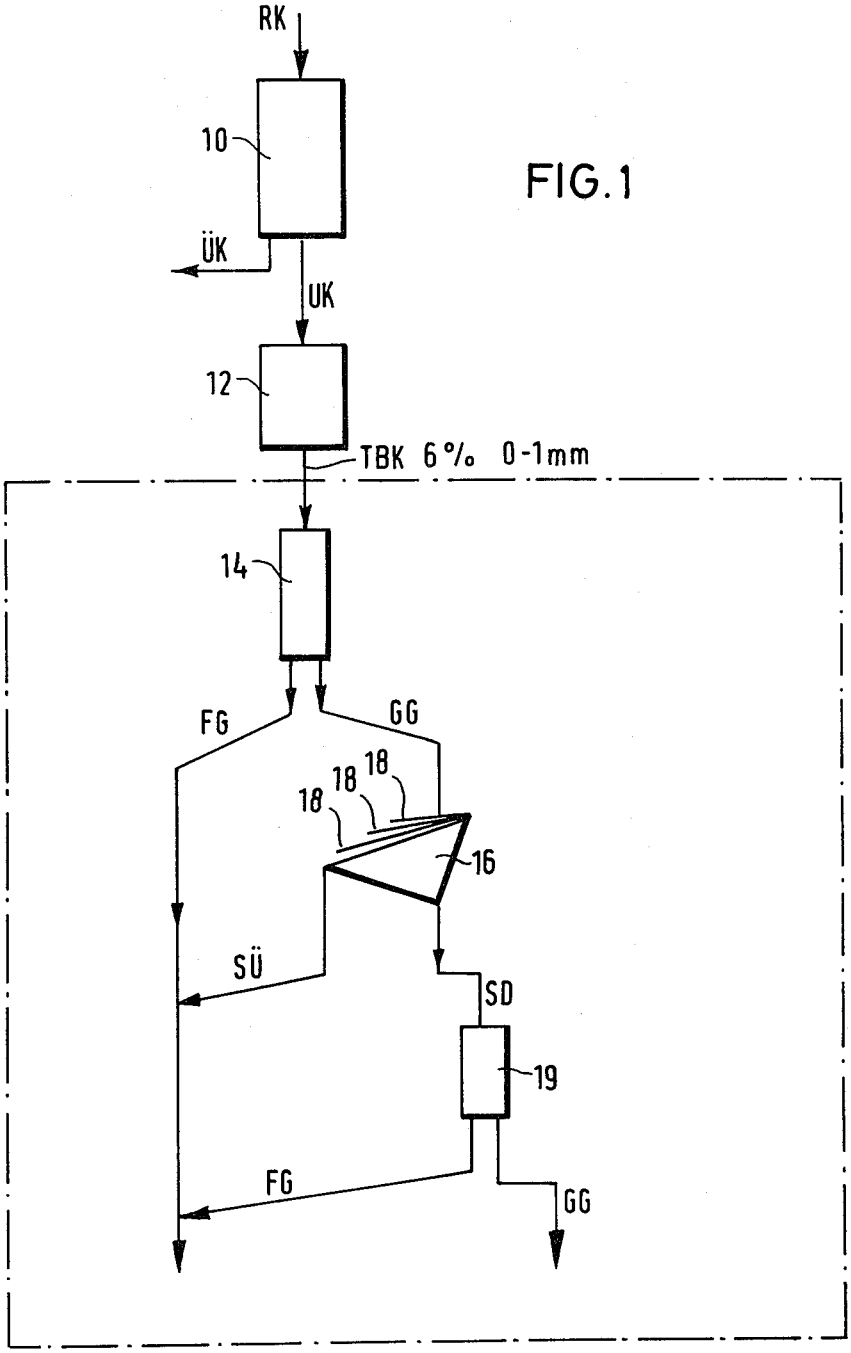
FIG. 1 shows the flow diagram of an installation for separating sand from sand-bearing brown coal or lignite.

Referring firstly to FIG. 1, in the flow diagram shown therein, freshly mined raw coal material RK, the water content of which is typically between 50 and 65%, with grain sizes ranging from 0 to 60 mm, is fed to a grading device 10, the dividing or cut-off line of which occurs at 6 mm. The material which passes over the sieve or screen, in a grain size range of from 6 to 60 mm, referred to as the oversize grain and indicated at ÜK, is removed from the grading device 10 for further use. The material which passes through the sieve or screen, referred to as the undersize grain and indicated at UK, being of a grain size of from 0 to 6 mm, is passed into a high-speed drying device 12 in which it is dried to the respectively required residual moisture content, of for example 14%, or 6%, or a value therebetween. The action of the heat which is involved in the drying operation results in shrinkage of the grains and also causes them to break up so that for example when the material is dried to a residual moisture content of 14%, the grain size may still be from 0 to 4 mm, while when it is dried to a residual moisture content of 6%, the grain size may be for example from 0 to 1 mm. The result of such breaking up of the grains of the feed material, which occurs in particular in high-speed drying and which is also to be attributed to the fact that evaporation in the moisture, some of it bound in colloid form, occurs very quickly, and possibly explosively, is that the grains of sand are extensively detached from the coal and therefore no longer remain attached or combined therewith so that, although the two components of the material are still mixed together, the individual particles or grains thereof are generally not joined together. In this respect it is assumed that the grains of coal have the usual ash content and the usual ash constituents, which cannot be separated from the coal substance by gaseous classifying and grading operations.

Hereinafter, similarly to the example discussed above, it is assumed that the undersize grain UK which is subjected to the high-speed drying operation in the device 12 is dried to a residual moisture content of 6%, and the dried material is in a grain size range of from 0 to 1 mm, with the coal in a grain size range of from 0 to 1 mm, while the sand is entirely or predominantly only in the grain size range of from 0.1 to 0.5 mm, that is to say, it only covers a part of the brown coal or lignite grain size range of from 0 to 1 mm.

The material (dry brown coal or lignite), as indicated at TBK, leaving the high-speed drying device 12, is fed to an air or gas classifier 14 in which the material is graded or sized under the effect of forces due to gravity, using air or another gas as the separation medium. This operation is carried out under such conditions, in regard to equal-falling particles or classes, that, with the dividing or cut-off line in respect to the brown coal or lignite at 0.5 mm, the brown coal or lignite in the size range of from 0.5 to 1 mm and all the sand in the grain size range of from 0.1 to 0.5 mm remain in the coarse material from the classifier, whereas all the brown coal or lignite which is in the grain size range of from 0 to 0.5 mm is removed by the classifier air and forms the fine component as indicated at FG from the gaseous classifying operation. The fine component FG is then passed on to the purpose to which the sand-free coal is to be put. The coarse component CG which contains the brown coal or lignite or more than 0.5 mm in size and all the sand in the grain size range of from 0.1 to 0.5 mm is passed to a sieving or screening device 16, the dividing or cut-off line of which occurs at a grain size value of 0.5 mm. The individual sieve or screen elements or surfaces 18 are disposed one above the other at inclined angles relative to the horizontal, which progressively increase downwardly in the device 16. The material which passes over the sieving or screening device 16, as indicated at SU, contains the coal whereas the material which passes through the device 16, as at SD, is formed by sand which may still contain some residual coal which is to be attributed in particular to the effects of abrasion on the coal during the sieving operation. The coal forming the material SU which passes over the sieving device is added to the coal which has already been separated out in the gaseous classifier 14. The material SD which passes through the sieving device 16 is passed to a post-classifying gaseous classifier 19 in which any improperly graded grain, that is to say, any coal which is still to be found in the sand, is separated out, and added as fine component FG to the rest of the coal from which the sand has been removed. The coarse component GC which issues from the second gaseous classifier 19 is almost exclusively formed by sand which can be dumped, or used in some other manner.

Figure 2:
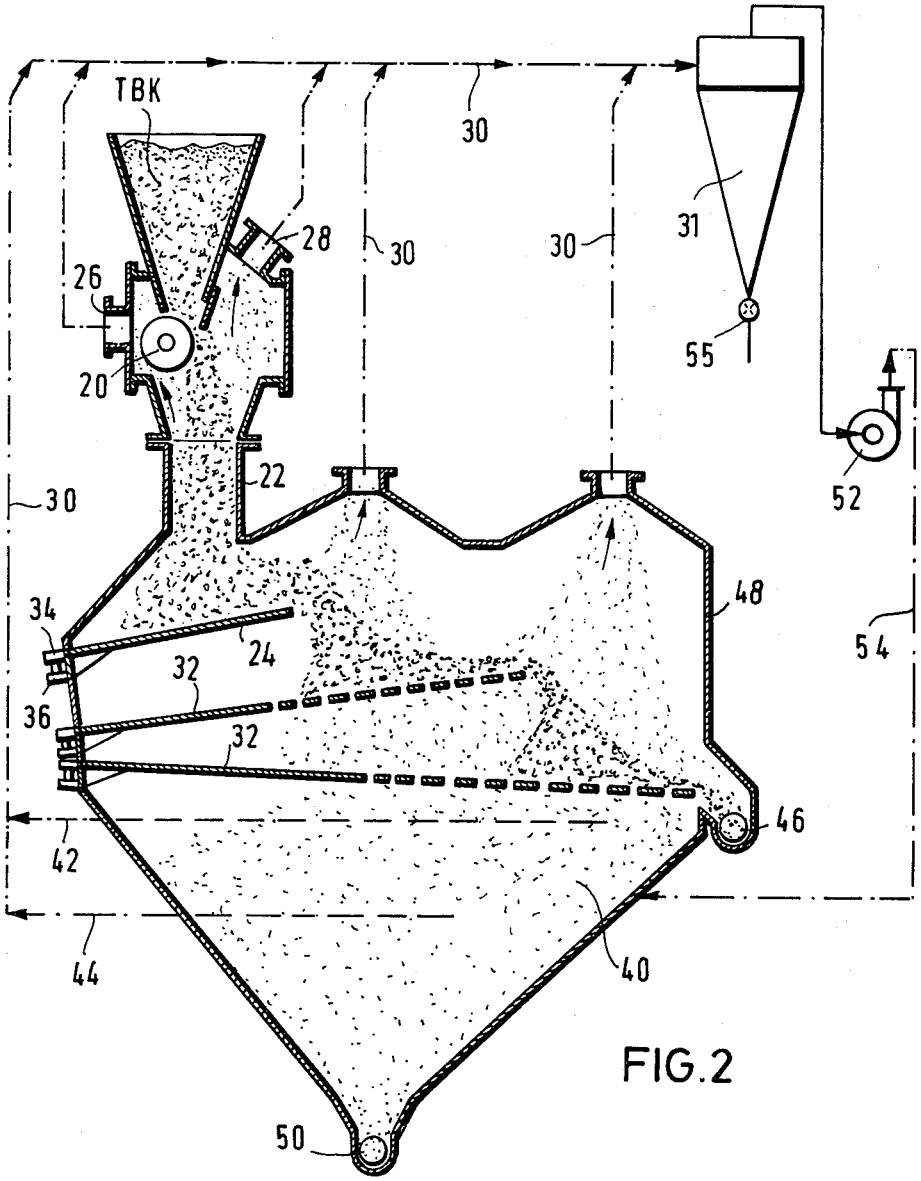
FIG. 2 shows a view in longitudinal section through a combined apparatus for carrying out gaseous classifying and grading operations.

FIG. 2 shows in detail features of an embodiment of apparatus for carrying out the gaseous classifying and grading operations, corresponding to the area indicated by the dash-dotted square in FIG. 1. The dried sand-bearing brown coal or lignite TBK is passed by way of a metering and feed roller 20 to an air or wind gaseous classifier 22 through which it passes under free-fall conditions. At its lower end, the gaseous classifier 22 is delimited by an oscillating conveyor channel 24 which receives the material passing through the gaseous classifier. While passing through the gaseous classifier 22, particles of coal in the grain size range of from 0 to 0.5 mm are entrained by a flow of air or other gas which flows through the gaseous classifier 22 in the opposite direction to the direction in which the material falls therethrough, and are passed with the air or gas through outlets 26 and 28 to a conduit 30 which communicates with a fine material separator or trap which is shown in the form of a cyclone separator 31.

The coarser coal fraction, in the range of from 0.5 to 1 mm, which has remained in the residual material representing the coarse component, and sand of a grain size of from 0.1 to 0.5 mm, pass on to the oscillating conveyor screens or sieves 32, of which only two are shown in the drawing, below the channel 24. The channel 24 and the screens or sieves 32 may be driven by suitable drive means such as electromagnetic vibrator means 34, excitation means 36 which operate on the principle of an unbalance arrangement, shakers or other devices which are not shown in the drawing. Material is transferred from the channel 24 to the sieves or screens 32 and from each sieve or screen to the sieve or screen disposed therebelow by a cascade-like flow, the discharge following a parabolic path which results in the material being repeatedly loosened up in its movement through the installation. That promotes the removal of fine grains of coal by means of dust removal apertures 42 and dust removal lances 44 which are disposed laterally and within the space or chamber 40 towards the bottom of the installation. The resulting air-coal mixture is also passed to the fine component separator 31 by way of the conduit 30. The coal, which is now at least substantially free of sand, is removed from the housing 48 enclosing the whole system, by way of the discharge means 46. The sand which is separated by settling leaves the housing 48 by way of a discharge means 50. The air or gas flow which is required for the gaseous classifying operation is produced by a fan 52, the outlet of which is as shown connected by way of a conduit 54 to the space enclosed by the housing 48. The fine-grain coal which is separated out in the separator 31 is removed from the system by way of a discharge means 55.

The arrangement of gaseous classifying and sieving or screening device or devices within a common housing 48 has the advantage of a simplified construction, especially as the gaseous classifying and sieving operations can be superimposed one upon the other, ie can be carried out virtually at the same time, and the material involved does not have to be transferred between a large number of pieces of equipment.

Advantageously, the arrangement uses oscillating conveyors and oscillating conveyor screens or sieves which have individual drive means and which are controllable in such a way that the inertial oscillating forces which are otherwise normally found in sieving or screening machines are reduced to a minimum.

It will be seen therefore that the above-described combination of steps permit sand to be economically removed from material containing sand and brown coal or lignite, to such a degree that that can be used in a normal manner, without the need to take special steps or precautions to permit such use.

It will be appreciated that the above-described process and apparatus were described by way of illustrative example only and that various other modifications and alterations may be made therein without thereby departing from the scope of the present invention.

What is claimed is:

1. A process for separating sand from a brown coal material containing sand, the sand content of which is at least predominantly in a grain size range which covers only a part of the grain size range of the brown coal, with the grain size of the coarsest grains of the sand to be removed being markedly below the grain size of the coarsest grains of the brown coal, comprising carrying out at least one gaseous classifying operation to remove from said material the brown coal in the grain size range which is between zero and at least the grain size corresponding to the maximum grain size of the sand to be removed, and subjecting the remaining material to a sieving operation, the cut-off line of which is in the region of the grain size of the coarsest grains of the sand to be removed.

2. A process as set forth in claim 1 wherein the position of the cut-off line in the gaseous classifying operation in respect to the brown coal is so selected that it is directly above the maximum sand grain size.

3. A process as set forth in claim 1 wherein the position of the cut-off line in the gaseous classifying operation in respect of the brown coal is so selected that it is at a distance above the maximum sand grain size.

4. A process as set forth in claim 1 wherein the position of the cut-off line in the gaseous classifying operation is so selected that the coarsest coal grains in the fine material removed in the sifting operation have a speed of fall which is slightly less than that of the sand of the smallest grain size.

5. A process as set forth in claim 1 wherein the coarse material remaining after gaseous classifying is subjected to an additional gaseous classifying operation during sieving.

6. A process as set forth in claim 1 wherein the material that passes through the sieve is subjected to a post-gaseous classifying operation.

7. A process as set forth in claim 1 wherein the sieving operation is effected by means of a plurality of sieves arranged one below the other, the angles of inclination thereof and the mesh size thereof varying from one sieve to another.

8. A process as set forth in claim 7 wherein said angles of inclination increase upwardly and said mesh sizes increase upwardly.

9. A process as set forth in claim 1 wherein the material is subjected to a drying operation before the first gaseous classifying operation.

10. A process as set forth in claim 9 wherein said drying operation is a high-speed heat drying operation.

11. A process for removing sand from a material containing sand and brown coal, the sand in the material being at least predominantly in a grain size range which covers only part of the grain size range of the brown coal, with the grain size of the coarsest sand grains being substantially below the grain size of the coarsest coal grains, comprising:

subjecting the material to a grading step to adjust the material to a given maximum grain size above the grain size of the coarsest sand grains, subjecting the material remaining after grading to a drying operation to adjust the residual moisture content thereof;

subjecting the material to a gas classifying operation to remove a fine coal component from the material, the said fine coal component being of a grain size between zero and at least the grain size corresponding to the maximum grain size of the sand to be removed, and subjecting the coarser component from the gas classifying operation to a sieving operation, the cut-off point of which is in the region of the grain size of the coarsest sand grains, thereby to separate the sand from the coal in said coarser component.

12. A process as set forth in claim 11 wherein the coarse material remaining after gas classifying is subjected to an additional gas classifying step during the sieving operation.

13. A process as set forth in claim 11 wherein the material that passes through the sieve in the sieving operation is subjected to a further gas classifying operation.

14. A process as set forth in claim 11 wherein said gas classifying and sieving operations are performed within a common housing.

* * * * *